US011371724B2

(12) United States Patent
Lorang

(10) Patent No.: US 11,371,724 B2
(45) **Date of Patent: *Jun. 28, 2022**

(54) DEHUMIDIFICATION DRAINAGE SYSTEM WITH MIST ELIMINATOR

(71) Applicant: Therma-Stor LLC, Madison, WI (US)

(72) Inventor: Grant M. Lorang, Lake Mills, WI (US)

(73) Assignee: THERMA-STOR LLC, Madison, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/920,531

(22) Filed: Jul. 3, 2020

(65) Prior Publication Data

US 2020/0340691 A1 Oct. 29, 2020

Related U.S. Application Data

(63) Continuation of application No. 15/999,546, filed on Aug. 20, 2018, now Pat. No. 10,775,057.

(51) Int. Cl.
*F24F 3/14* (2006.01)
*F24F 13/22* (2006.01)

(52) U.S. Cl.
CPC .... *F24F 3/1405* (2013.01); *F24F 2003/1446* (2013.01); *F24F 2013/227* (2013.01); *F24F 2013/228* (2013.01)

(58) Field of Classification Search
CPC ..... F24F 3/1405; F24F 2013/227; F24F 2013/228; F24F 2003/1446
See application file for complete search history.

(56) References Cited

U.S. PATENT DOCUMENTS

| | | | | |
|---|---|---|---|---|
| 3,282,574 | A * | 11/1966 | De Pas | F24F 6/06 261/29 |
| 3,770,254 | A | 11/1973 | Morrow | |
| 4,835,984 | A | 6/1989 | Vyavaharkar et al. | |
| 4,843,835 | A | 7/1989 | Goetz et al. | |
| 5,249,433 | A | 10/1993 | Hardison et al. | |
| 5,575,079 | A | 11/1996 | Yokomizo et al. | |
| 6,085,539 | A | 7/2000 | Meyer | |
| 6,360,911 | B1 | 3/2002 | Arnold | |
| 10,458,730 | B2 * | 10/2019 | Lorang | F24F 1/02 |
| 10,775,057 | B2 * | 9/2020 | Lorang | F24F 3/1405 |
| 2003/0221439 | A1 | 12/2003 | Bush et al. | |

(Continued)

*Primary Examiner* — Kun Kai Ma
(74) *Attorney, Agent, or Firm* — Baker Botts, LLP

(57) ABSTRACT

A dehumidification system includes an evaporator, a condenser positioned next to the evaporator, and a drain pan including a mist eliminator. The drain pan is disposed at least partially below the evaporator and the condenser. The drain pan at least includes a basin disposed at least partially below the evaporator. The basin includes a sloped bottom, a first rib disposed on the sloped bottom, a second rib parallel to the first rib and including a central gap, a third rib positioned between the first rib and the second rib, and an angled rib attached to the second rib. The third rib is parallel to and shorter than the first rib. The third rib is configured to at least partially block the central gap of the second rib. The angled rib is inclined towards the third rib and configured to change a velocity vector of the air flowing through the drain pan. The mist eliminator is configured to remove water droplets from the air.

20 Claims, 10 Drawing Sheets

(56) References Cited

U.S. PATENT DOCUMENTS

| | | | | |
|---|---|---|---|---|
| 2007/0169494 | A1* | 7/2007 | Rembold | F25D 21/14 62/285 |
| 2007/0169497 | A1 | 7/2007 | Rios | |
| 2010/0281896 | A1 | 11/2010 | Al Watban | |
| 2015/0153094 | A1 | 6/2015 | Mercer et al. | |
| 2017/0191734 | A1 | 7/2017 | Grantham | |
| 2018/0010844 | A1 | 1/2018 | Booz et al. | |

* cited by examiner

DEHUMIDIFICATION DRAINAGE SYSTEM WITH MIST ELIMINATOR

CROSS-REFERENCE TO RELATED APPLICATIONS

This application is a continuation of U.S. patent application Ser. No. 15/999,546 filed Aug. 20, 2018, by Grant M. Lorang, and entitled "Dehumidification Drainage System with Mist Eliminator," which is incorporated herein by reference.

TECHNICAL FIELD

This disclosure relates generally to dehumidification, and more particularly to a dehumidification drainage system with a mist eliminator.

BACKGROUND

In certain situations, it is desirable to increase water removal capacity from a dehumidification system. For example, in fire and flood restoration application, it may be desirable to quickly remove water from areas of a damaged structure. To accomplish this, air flow may be increased through the dehumidification system. However, current dehumidification systems have proven inefficient in increasing water removal capacity by increasing air flow in the same space. The increased air flow leads to increased velocity, especially during defrost conditions. With high enough air velocity, the water droplets will eventually entrain in the air, reducing water removal performance.

SUMMARY

According to embodiments of the present disclosure, disadvantages and problems associated with previous dehumidification systems may be reduced or eliminated.

In some embodiments, a dehumidification system includes an evaporator, a condenser, and a drain pan. The condenser is positioned proximate to the evaporator. The drain pan is disposed at least partially below the evaporator and the condenser. The drain pan includes a basin, a central ridge, a shelf, and a mist eliminator. The basin of the drain pan is configured to collect water condensed from the evaporator and includes a sloped bottom, a first rib, a second rib, a third rib, an angled rib, and a drain opening. The sloped bottom of the basin is configured to allow water to flow from a first side of the basin towards a second side of the basin, wherein the first and the second side are parallel to a longitudinal direction. The first rib is disposed on the sloped bottom and positioned between a third side of the basin and a fourth side of the basin, wherein the third and the fourth side are perpendicular to the longitudinal direction. The first rib extends upwardly from the sloped bottom and partially across the sloped bottom along a lateral direction, wherein the lateral direction is perpendicular to the longitudinal direction. The second rib is disposed on the sloped bottom and positioned between the first rib and the third side of the basin. The second rib extends upwardly from the sloped bottom and partially across the sloped bottom. The second rib is parallel to the first rib and includes a central gap configured to restrict air flowing through the drain pan. The third rib is disposed on the sloped bottom and positioned between the first rib and the second rib. The third rib extends upwardly from the sloped bottom and partially across the sloped bottom. The third rib is parallel to and shorter than the first rib. The third rib is configured to at least partially block the central gap of the second rib along the longitudinal direction. The angled rib is disposed on the sloped bottom and positioned between the first rib and the second rib. The angled rib is further positioned between the third rib and the second side of the basin. The angled rib extends upwardly from the bottom and is attached to the second rib. The angled rib has an angle with respect to the second rib and is inclined towards the third rib. The drain opening is disposed at the fourth side of the basin. The central ridge of the drain pan is disposed proximate to the third side of the basin of the drain pan. The central ridge includes a wall along the lateral direction and is configured to accommodate a mist eliminator. The mist eliminator includes a member extending along the lateral direction. The member further includes a plurality of apertures. The shelf of the drain pan is disposed proximate to the central ridge so that the central ridge is sandwiched between the basin and the shelf. The shelf is configured to support the condenser.

In some embodiments, a dehumidification system includes an evaporator, a condenser, and a drain pan. The condenser is positioned proximate to the evaporator. The drain pan is disposed at least partially below the evaporator and the condenser. The drain pan at least includes a basin configured to collect water condensed from the evaporator. The basin includes a sloped bottom, a first rib, a second rib, a third rib, an angled rib, and a drain opening. The sloped bottom of the basin is configured to allow water to flow from a first side of the basin towards a second side of the basin, wherein the first and the second side are parallel to a longitudinal direction. The first rib is disposed on the sloped bottom and positioned between a third side of the basin and a fourth side of the basin. The first rib extends upwardly from the sloped bottom and partially across the sloped bottom along a lateral direction, wherein the lateral direction is perpendicular to the longitudinal direction. The second rib is disposed on the sloped bottom and positioned between the first rib and the third side of the basin. The second rib extends upwardly from the sloped bottom and partially across the sloped bottom. The second rib is parallel to the first rib and includes a central gap configured to restrict air flowing through the drain pan. The third rib is disposed on the sloped bottom and positioned between the first rib and the second rib. The third rib extends upwardly from the sloped bottom and partially across the sloped bottom. The angled rib is disposed on the sloped bottom and positioned between the first rib and the second rib. The angled rib extends upwardly from the bottom and has an angle with respect to the second rib. The drain opening is disposed at the fourth side of the basin.

In some embodiments, a dehumidifier drainage system includes a drain pan. The drain pan is disposed at least partially below an evaporator and a condenser. The drain pan at least includes a basin configured to collect water condensed from the evaporator. The basin includes a sloped bottom, a first rib, a second rib, a third rib, an angled rib, and a drain opening. The sloped bottom of the basin is configured to allow water to flow from a first side of the basin towards a second side of the basin, wherein the first and the second side are parallel to a longitudinal direction. The first rib is disposed on the sloped bottom and positioned between a third side of the basin and a fourth side of the basin. The first rib extends upwardly from the sloped bottom and partially across the sloped bottom along a lateral direction, wherein the lateral direction is perpendicular to the longitudinal direction. The second rib is disposed on the sloped bottom and positioned between the first rib and the third side of the basin. The second rib extends upwardly from the sloped bottom and partially across the sloped bottom. The second rib is parallel to the first rib and includes a central gap configured to restrict air flowing through the drain pan. The third rib is disposed on the sloped bottom and positioned between the first rib and the second rib. The third rib extends upwardly from the sloped bottom and partially across the sloped bottom. The angled rib is disposed on the sloped bottom and positioned between the first rib and the second rib. The angled rib extends upwardly from the bottom and has an angle with respect to the second rib. The drain opening is disposed at the fourth side of the basin.

Certain embodiments of the present disclosure may provide one or more technical advantages. For example, the ribs of certain embodiments of the drain pan, including the first rib and the second rib, are directly underneath below the lowest coils of the evaporator and are configured to restrict an area between the evaporator and the drain pan through which air may pass. This configuration minimizes the gap between the evaporator and the drain pan, restricting the air flowing between the evaporator and the drain pan, thereby reducing velocity of the air flowing through the drain pan, and preventing water from being entrained in the air. This may improve the efficiency of the dehumidification system. The central gap in the second rib allows water to drain from the backside of the second rib, in relation to the direction of airflow, but controls the air flow through the drain pan. The third rib that partially blocks the central gap of the second rib facilities reducing the velocity of the air flowing towards the central gap and reduces water entrainment in the air. The angled rib attached to the second rib is configured to reduce air velocity and change the velocity vector of the air exiting the central gap of the second rib so that the air does not drift sideways and carry the water droplets out of the drain pan. The mist eliminator has multiple advantages including separating entrained water droplets that fall from the bottom of the evaporator and changing the velocity vector of the air coming off of the bottom of the evaporator. This increases the performance of the dehumidifier by maximizing the amount of water drained after it has condensed on the evaporator. In some embodiments, the apertures of the mist eliminator are specifically designed to minimize air restriction during normal operation but also directly control water drainage during defrost conditions.

Other technical advantages of the present disclosure will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present disclosure and for further features and advantages thereof, reference is now made to the following description taken in conjunction with the accompanying drawings, in which.

DETAILED DESCRIPTION

Figure 1B:
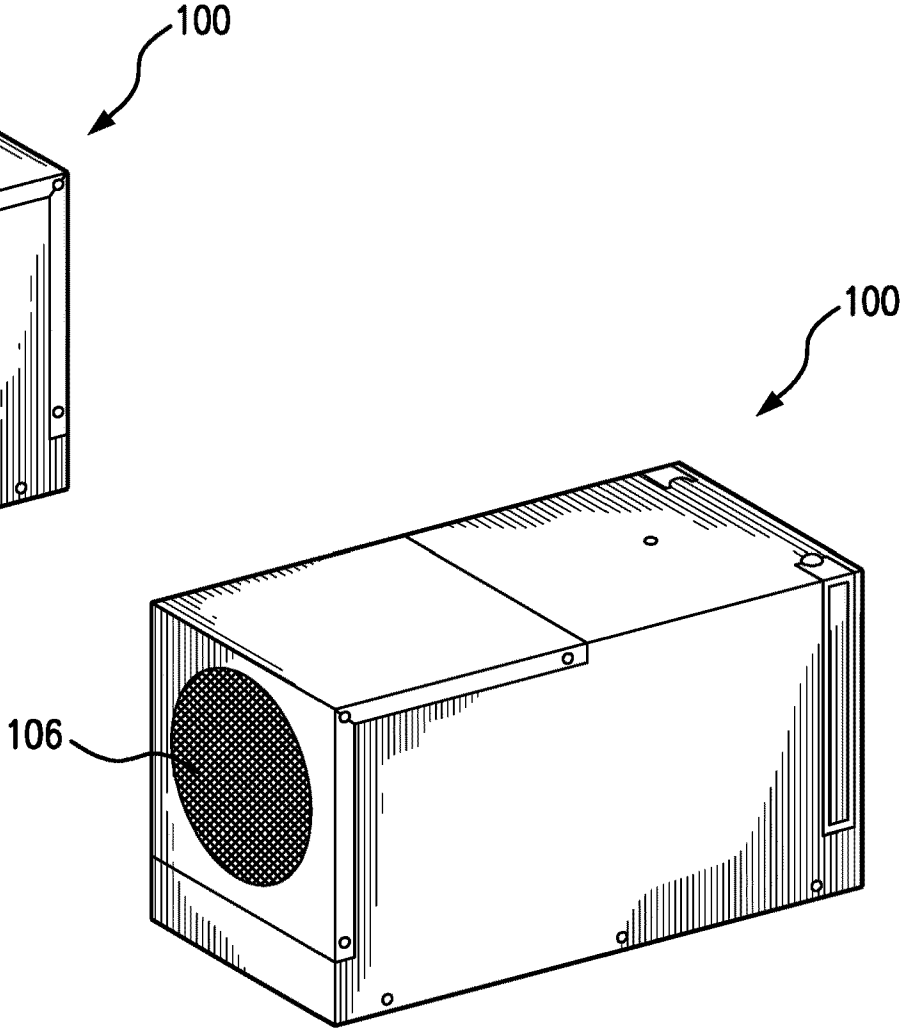
FIGS. 1A-1B illustrate perspective views of a dehumidification system, according to certain embodiments.

In certain situations, it is desirable to increase water removal capacity from a dehumidification system. For example, in fire and flood restoration applications, it may be desirable to quickly remove water from areas of a damaged structure. As another example, in resident applications, large amounts of dehumidification may become necessary when the latent load becomes uncomfortable. To accomplish this, air flow may be increased through the dehumidification system. However, current dehumidification systems have proven inefficient in increasing water removal capacity. For example, in current dehumidification systems, when the evaporator is operating at a temperature below dew point, ice may start to build in the coils of the evaporator. This drives a portion of the air drawn into the dehumidification system to flow underneath the evaporator and pick up water condensed in the drain pan below the evaporator. This negatively impacts the dehumidification system performance and durability by allowing water to be reabsorbed into the air and saturating internal components with water.

The disclosed embodiments provide a dehumidification system that includes various features to address the inefficiencies and other issues with current dehumidification systems. In some embodiments, the dehumidification system includes a dehumidifier drainage system that is configured to efficiently increase the water removal capacity of the dehumidification system. Specifically, the dehumidifier drainage system includes a drain pan including a basin, a central ridge, and a mist eliminator. The basin of the drain pan includes a sloped bottom, a first rib, a second rib, a third rib, an angled rib, and a drain opening. In some embodiments, the first rib and the second rib are directly underneath the lowest coils of the evaporator and are configured to restrict an area between the evaporator and the drain pan through which air may pass. This configuration minimizes the gap between the evaporator and the drain pan, thereby restricting the air flowing between the evaporator and the drain pan, reducing velocity of the air flowing through the drain pan, and preventing water from being entrained in the air. This may improve the efficiency of the dehumidification system. The second rib includes a central gap which allows water to drain from the backside of the second rib to the drain opening. This configuration allows the drain pan to be more compact and still directly control air flow and water. The third rib partially blocks the central gap of the second rib. This reduces the velocity of the air flowing towards the central gap and reduces water entrainment in the air. The angled rib is attached to the second rib and is configured to reduce air velocity and change the velocity vector of the air exiting the central gap of the second rib. The change of the velocity vector will direct the highest velocity airflow towards the most aggressive portion of the mist eliminator. The mist eliminator has multiple advantages including separating entrained water droplets that fall from the bottom of the evaporator and changing the velocity vector of the air coming off of the bottom of the evaporator coil. This increases the performance of the dehumidifier by maximizing the amount of water drained after it has condensed on the evaporator. In some embodiments, the apertures of the mist eliminator are specifically designed to minimize air restriction during normal operation but also directly control water drainage during defrost conditions.

Figure 1A:
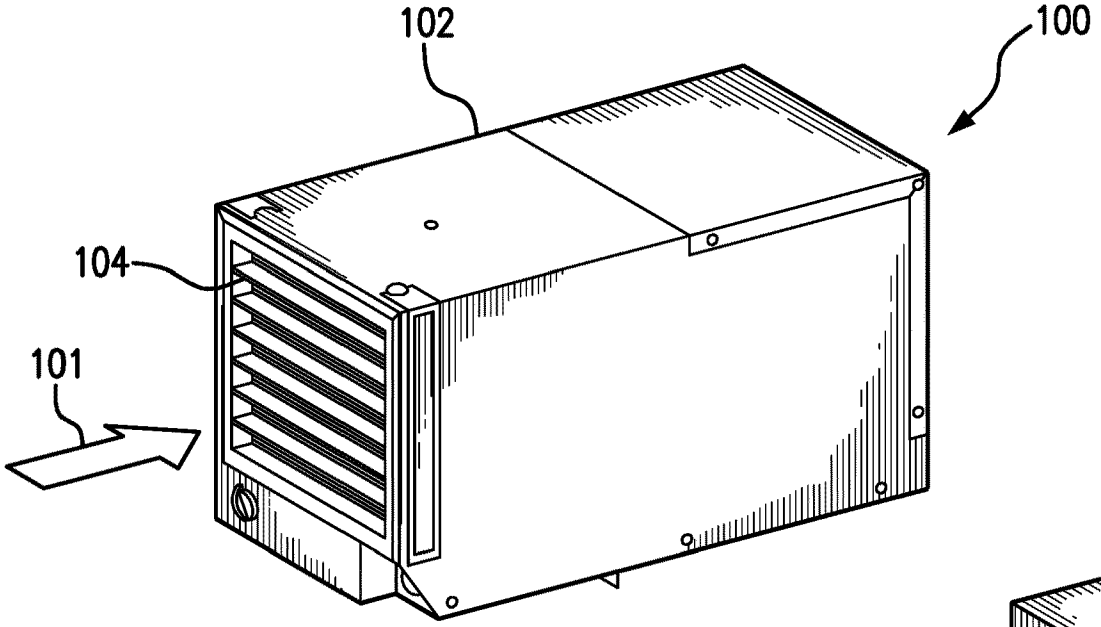
Figure 2:
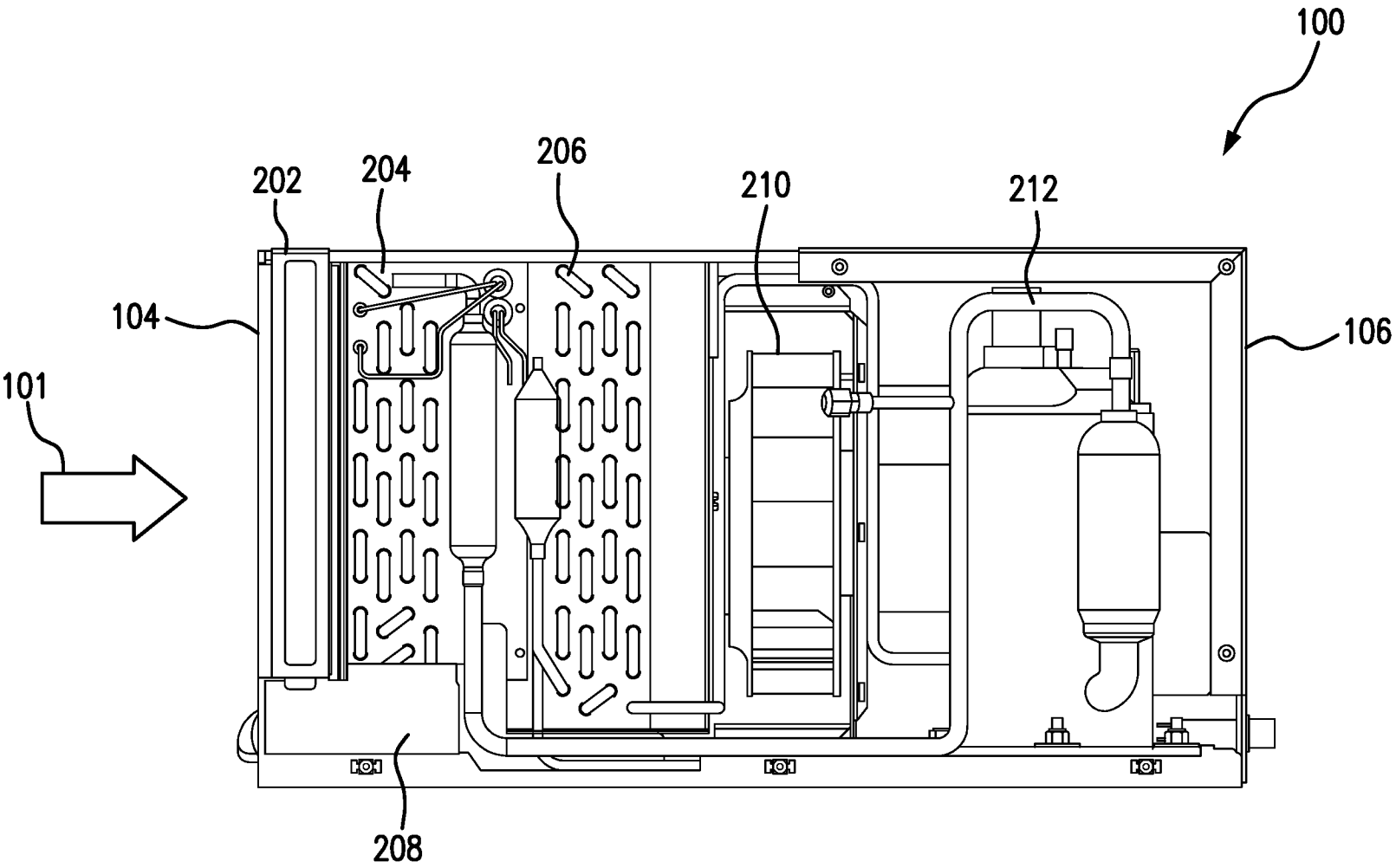
FIG. 2 illustrates internal components of the dehumidification system of FIG. 1, according to certain embodiments.
Figure 3A:
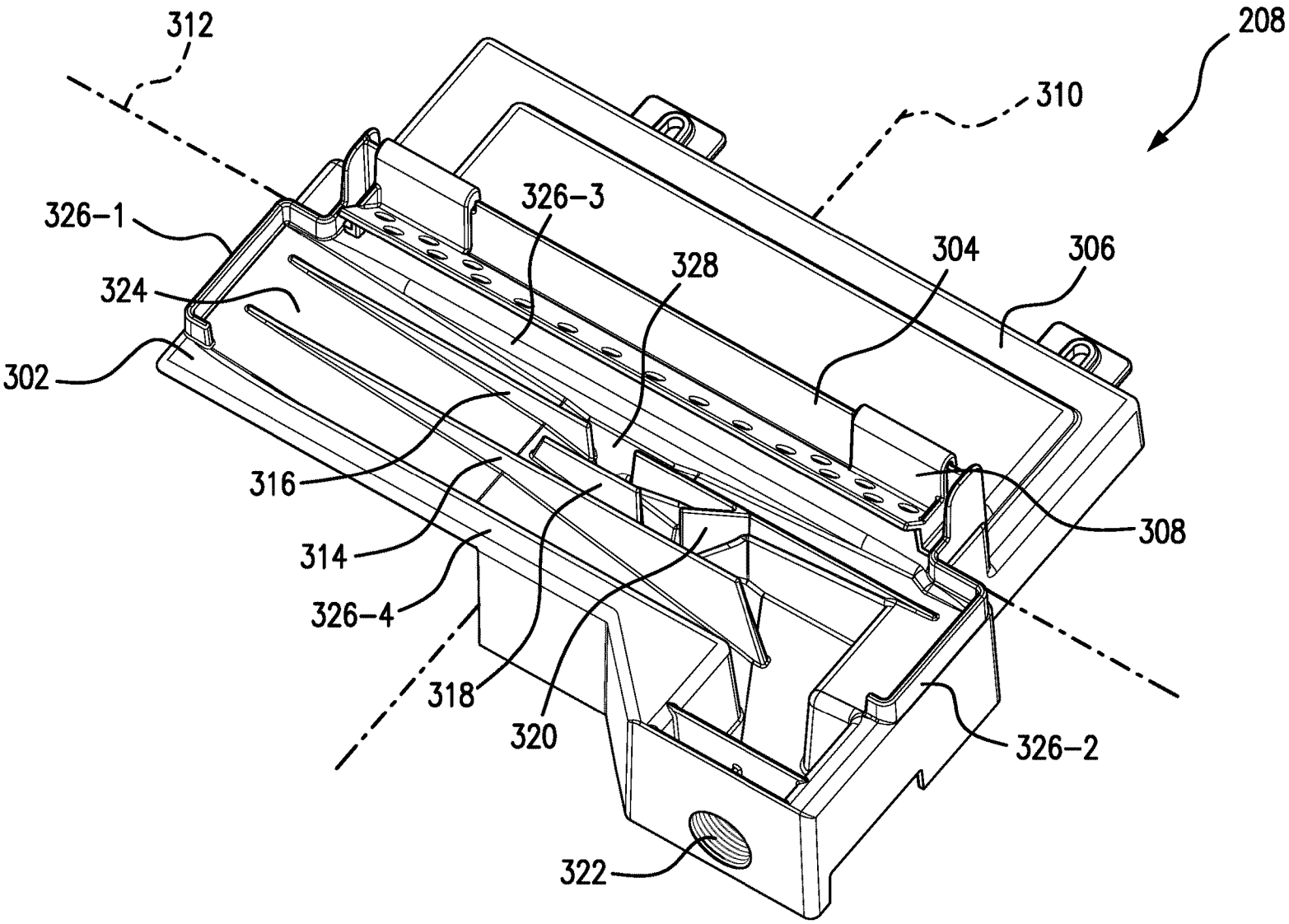
FIG. 3A illustrates a perspective view of a drain pan in the dehumidification system of FIG. 2, according to certain embodiments.
Figure 3B:
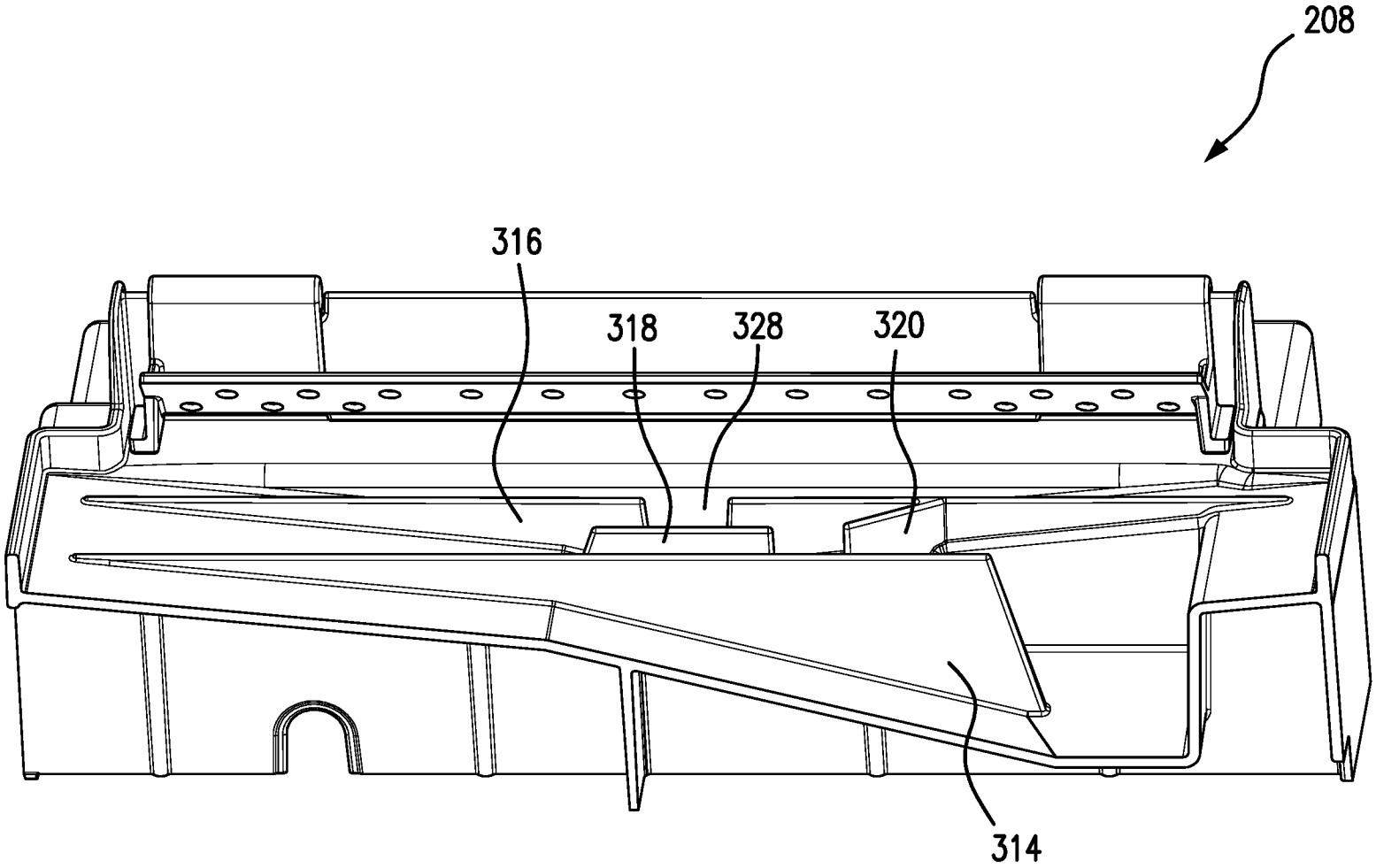
FIG. 3B-3D illustrate cross-sectional perspective views of the drain pan of FIG. 3A, according to certain embodiments.
Figure 3C:
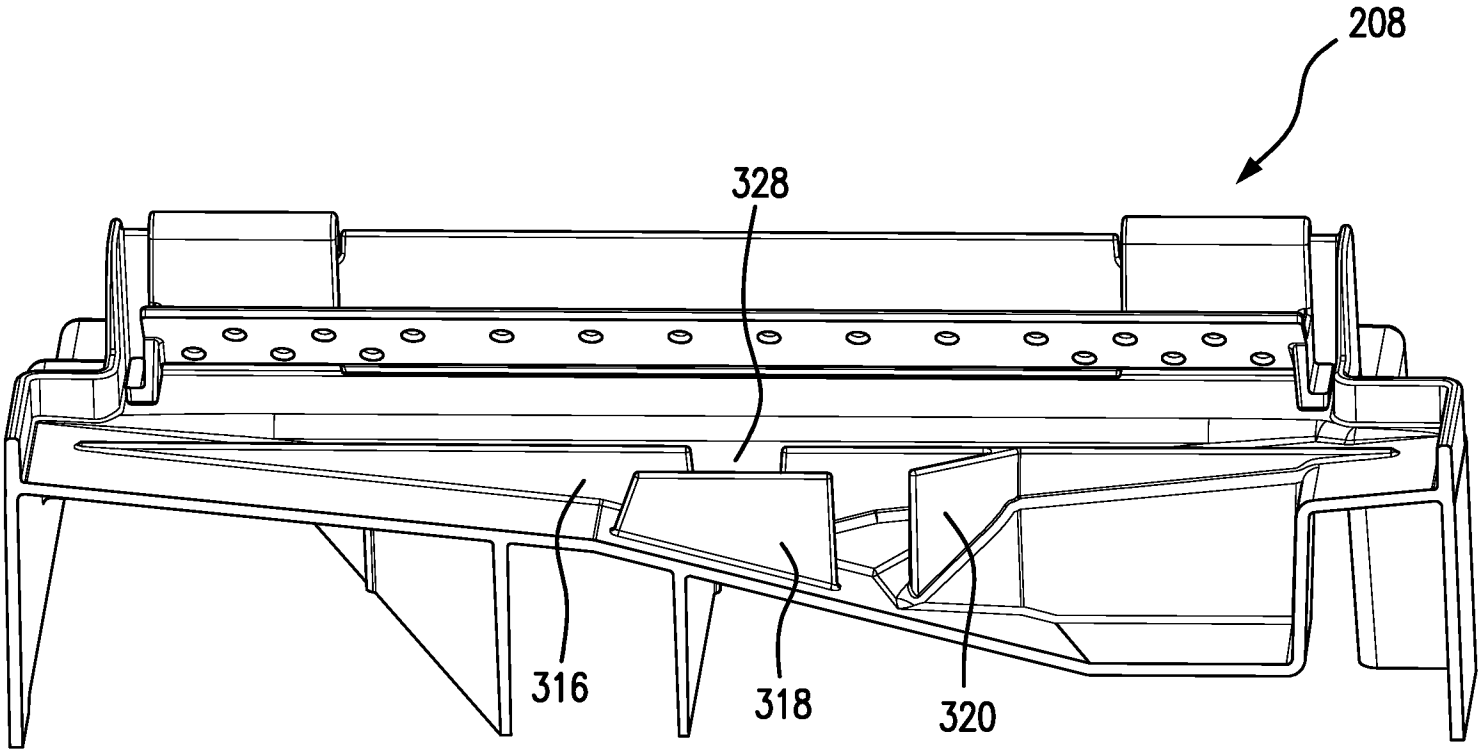
Figure 3D:
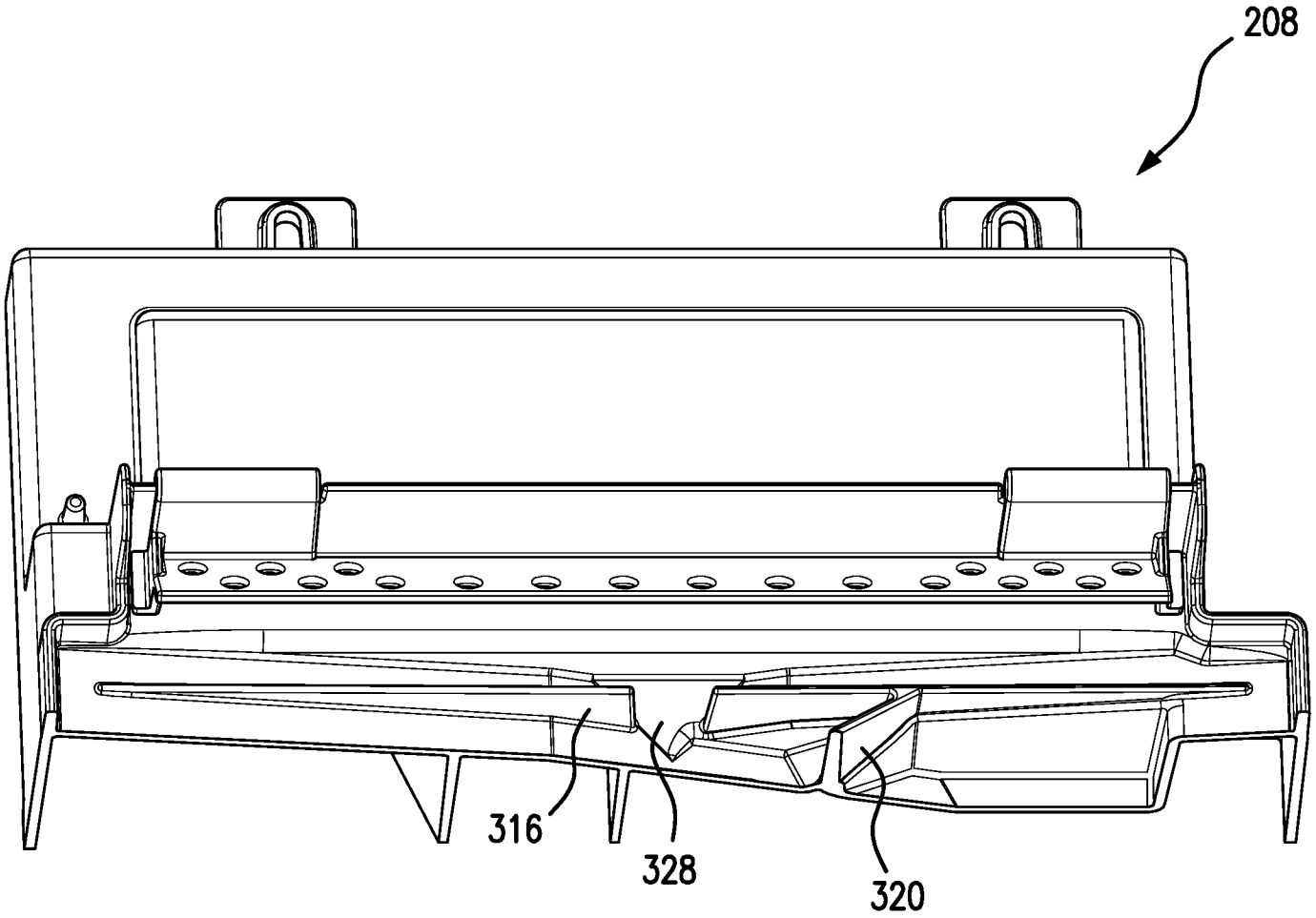
Figure 3E:
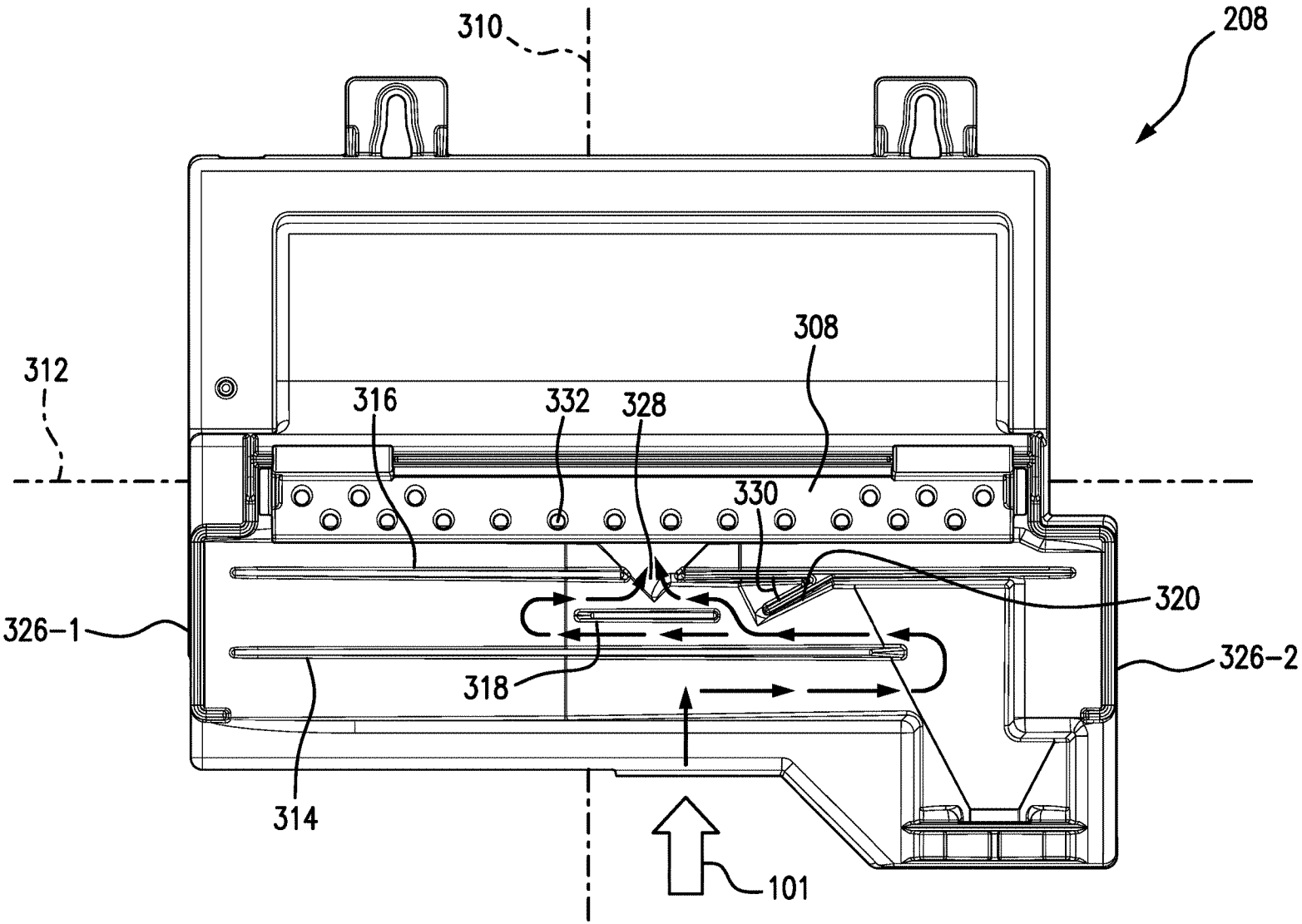
FIG. 3E illustrates a top view of the drain pan of FIG. 3A, according to certain embodiments.
Figure 3F:
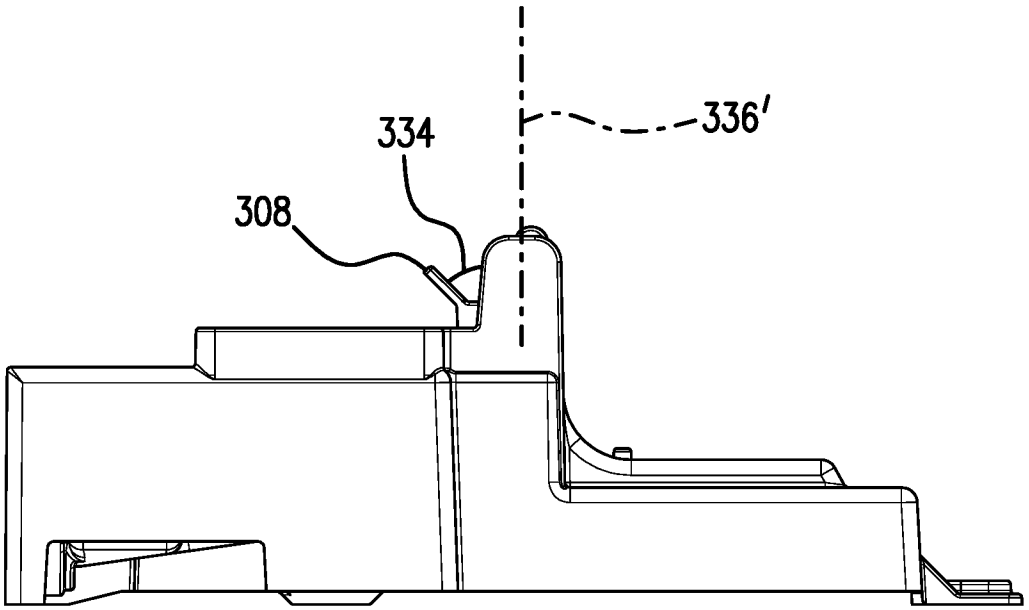
FIG. 3F illustrates a side view of the drain pan of FIG. 3A, according to certain embodiments.
Figure 3G:
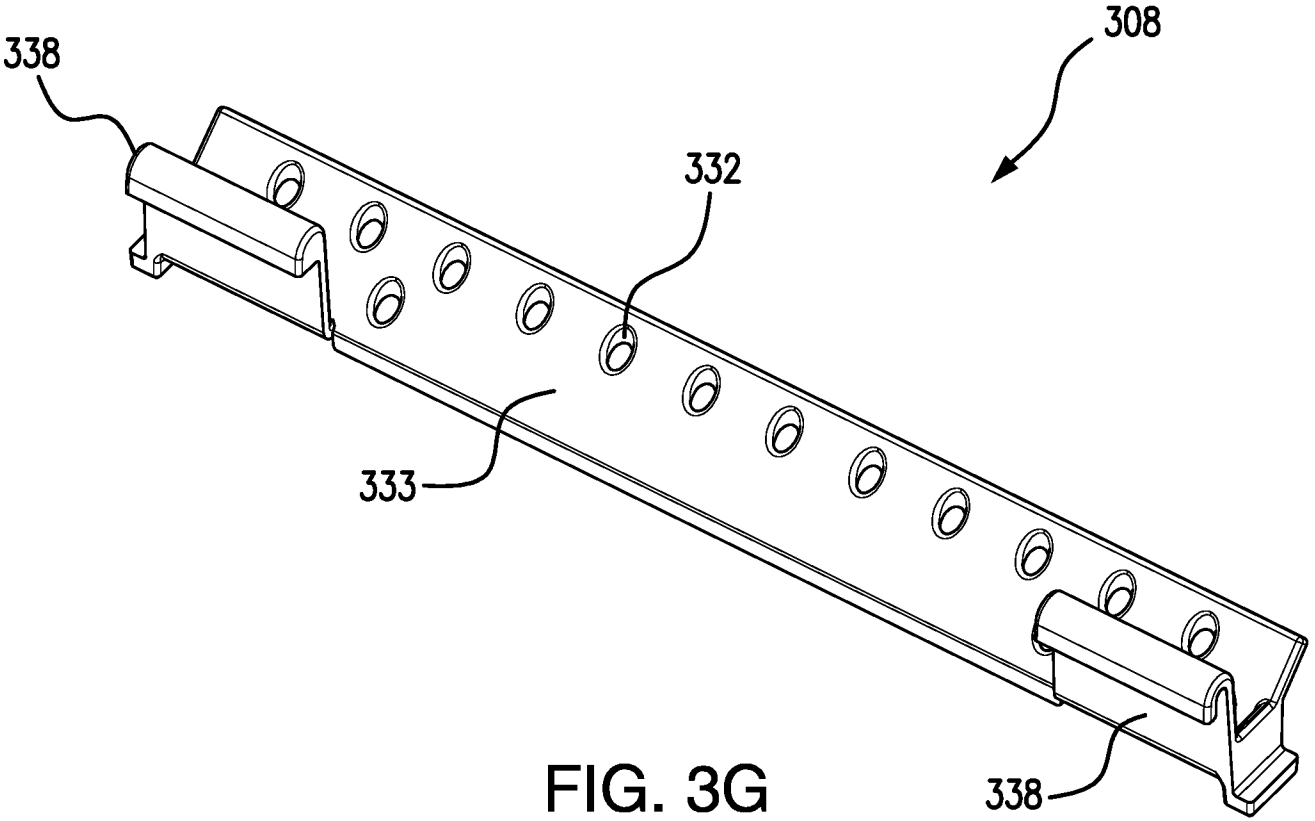
FIG. 3G illustrates a perspective view of a mist eliminator, according to certain embodiments.
Figure 3H:
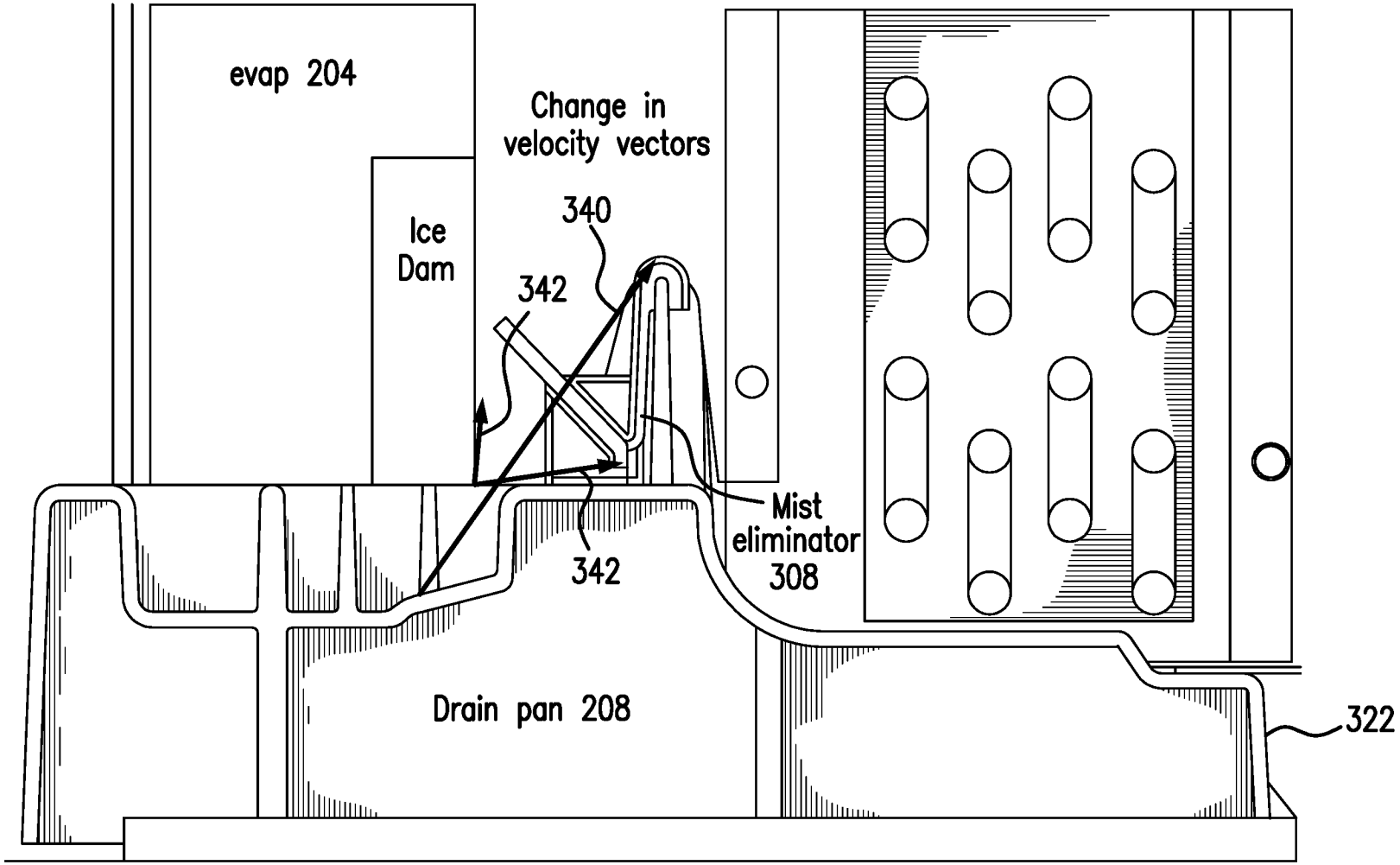
FIG. 3H illustrates a side view of the drain pan of FIG. 3A, according to certain embodiments.

These and other advantages and features of certain embodiments are discussed in more detail below in reference to FIGS. 1A-3H. FIGS. 1A-1B illustrate perspective views of certain embodiments of a dehumidification system; FIG. 2 illustrates certain embodiments of internal components of a dehumidification system; FIG. 3A illustrates a perspective view of certain embodiments of a drain pan in a dehumidification system; FIG. 3B illustrates a cross-sectional perspective view of certain embodiments of a drain pan in a dehumidification system; FIG. 3C illustrates a cross-sectional perspective view of certain embodiments of a drain pan in a dehumidification system; FIG. 3D illustrates a cross-sectional perspective view of certain embodiments of a drain pan in a dehumidification system; FIG. 3E illustrates a top view of certain embodiments of a drain pan in a dehumidification system; FIG. 3F illustrates a side view of certain embodiments of a drain pan in a dehumidification system; FIG. 3G illustrates a perspective view of certain embodiments of a mist eliminator in a dehumidification system; and FIG. 3H illustrates a side view of certain embodiments of a drain pan in a dehumidification system.

FIGS. 1A-1B illustrate perspective views of a dehumidification system 100, according to certain embodiments. In some embodiments, dehumidification system 100 includes a cabinet 102, an airflow inlet 104, and an airflow outlet 106. While a specific arrangement of these and other components of dehumidifier 100 are illustrated in these figures, other embodiments may have other arrangements and may have more or fewer components than those illustrated.

In general, dehumidification system 100 provides dehumidification to an area (e.g., a room, a floor, etc.) by moving air through dehumidification system 100. To dehumidify air, dehumidification system 100 draws in a moist airflow 101 that enters cabinet 102 via airflow inlet 104, travels through the internal components of dehumidification system 100, and then exits cabinet 102 via airflow outlet 106. Water removed from airflow 101 may be captured within a water reservoir (e.g., a drain pan) of dehumidification system 100.

Cabinet 102 may be of any appropriate shape and size. In some embodiments, cabinet 102 includes multiple panels (or sides). In some embodiments as illustrated, airflow inlet 104 is on a front side panel of cabinet 102, and airflow outlet 106 is on a back side panel.

Airflow inlet 104 is generally any opening in which airflow 101 enters dehumidification system 100. In some embodiments, airflow inlet 104 is located on a front side panel as illustrated, but may be in any other appropriate location on other embodiments of dehumidification system 100. In some embodiments, airflow inlet 104 is square or rectangular in shape. In some embodiments, airflow inlet 102 is oval or circular in shape. In other embodiments, airflow inlet 102 may have any other appropriate shape or dimension. In some embodiments, airflow inlet 102 includes a grate or grill that is formed out of geometric shapes. For example, some embodiments of airflow inlet 102 includes a grill formed from hexagons, octagons, and the like. In some embodiments, a removable air filter may be installed proximate to airflow inlet 104 to filter airflow 101 as it enters dehumidification system 100.

Airflow outlet 106 is generally any opening in which airflow 101 exits dehumidification system 100. In some embodiments, airflow outlet 106 is located on a back side panel as illustrated, but may be in any other appropriate location on other embodiments of dehumidification system 100. Similar to airflow inlet 104, airflow outlet 106 includes a grate or grill that is formed out of geometric shapes such as hexagons, octagons, and the like. In some embodiments, airflow outlet 106 may be circular or oval in shape, but may have any other appropriate shape or dimension.

Dehumidification system 100 includes various internal components to provide dehumidification to airflow 101. As illustrated in FIG. 2, some embodiments of dehumidification system 100 include an air filter 202, an evaporator 204, a condenser 206, a drain pan 208, an impeller 210, and a compressor 212. These and other internal components of dehumidification system 100 are uniquely arranged to minimize the size of dehumidification system 100. In some embodiments as illustrated, condenser 206 is sandwiched between evaporator 204 and impeller 210. In some embodiments, evaporator 204 is located proximate to airflow inlet 104. In some embodiments, a removable air filter 202 is provided between evaporator 204 and airflow inlet 104 to filter airflow 101 before it enters evaporator 204. In some embodiments, drain pan 208 is located partially below evaporator 204 and condenser 206. In some embodiments, compressor 212 is located between impeller 210 and airflow outlet 106 as illustrated.

Air filter 202 is configured to remove solid particles such as dust, pollen, mold, and bacterial from airflow 101 entering dehumidification system 100. In some embodiments, air filter 202 is located proximate to the airflow inlet 104. Air filter 202 is generally any appropriate type of filter that can capture mold, pollen, dust mites, and other particulates out of air.

Evaporator 204 is configured to absorb heat from airflow 101 and condense the moisture in airflow 101. In some embodiments, evaporator 204 includes a finned-tube evaporator comprising tube coils covered with fins. The fins added to the tubes extend into the spaces between the tubes to permit more of airflow 101 to come into contact with cold evaporator 204. This design allows evaporator 204 to be made dimensionally smaller while still providing a reasonable heat transfer capability. During operation, evaporator 204 gets cold enough (below the dewpoint) to pull water out of airflow 101. Water will drip down the coils of evaporator 204 to drain pan 208. In some embodiments, the tubes and the fins of evaporator 204 are made of copper or aluminum. In yet other embodiments, evaporator 204 may be any type of evaporators such as microchannel, bare tube evaporator, plate evaporators, etc., and may be made of any appropriate material such as steel or aluminum.

Condenser 206 is configured to reject heat to airflow 101. In some embodiments, condenser 206 includes a microchannel condenser comprising condenser coils that are made of aluminum in some embodiments. In general, a microchannel condenser provides numerous features including a high heat transfer coefficient, a low air-side pressure restriction, and a compact design (compared to other solutions such as finned tub exchangers). These and other features make microchannel condensers good options for condensers in air conditioning systems where inlet air temperatures are high and airflow is high with low fan power. In some embodiments, condenser 206 includes one condenser coil. In some embodiments, condenser 206 includes two or more condenser coils to achieve a reasonable temperature. In yet other embodiments, condenser 206 may be any type of condensers, and may be made of any appropriate material.

Evaporator 204 and condenser 206 make it possible to complete the heat exchange process. Cold evaporator 204 condenses the water in airflow 101, which is removed, and then airflow 101 is reheated by the condenser coils of condenser 206. The now dehumidified, re-warmed airflow 101 is released into the environment.

Drain pan 208 is configured to collect water condensed from evaporator 204. Drain pan 208 is located partially below evaporator 204 and condenser 206. In some embodiments, drain pan 208 is any appropriate tank, basin, container, or area within cabinet 102 to collect and hold water removed from airflow 101. A particular embodiment of drain pan 208 is described in more detail below in reference to FIGS. 3A-3F.

Dehumidification system 100 further includes an impeller 210 that, when activated, draws airflow 101 into dehumidification system 100 via airflow inlet 104, causes airflow 101 to flow through dehumidification system 100, and exhausts airflow 101 out of airflow outlet 106. In some embodiments, impeller 210 is located within cabinet 102 adjacent to condenser 206 as illustrated in FIG. 2. In some embodiments, impeller 210 is a backward inclined impeller configured to generate airflow 101 that flows through dehumidification system 100 for dehumidification and exits dehumidification system 100 through airflow outlet 106. In some embodiments, impeller 210 may be any other type of air mover (e.g., axial fan, forward inclined impeller, etc.) in other embodiments of dehumidification system 100.

Compressor 212 is configured to circulate the refrigerant in dehumidification system 100 under pressure. In some embodiments, compressor 212 is located adjacent to airflow outlet 106 as illustrated in FIG. 2. In some embodiments, compressor 212 creates the necessary flow of refrigerant that travels through the coils in dehumidification system 100. For example, compressor 212 may pump the refrigerant to the condenser 206, through the expansion valve, and into the evaporator 204 to complete the refrigeration cycle. In some embodiments, compressor 212 is a rotary compressor that includes a shaft with an eccentric lobe. The eccentric lobe of the rotary compressor rotates inside the cylinder of the compressor 212, and pushes the refrigerant through the cylinder of the compressor generating the necessary flow. Rotary compressors are small in size and quiet, which makes them a good candidate for compressors used in a residential or commercial dehumidifier. In some embodiments, compressor 212 may be any other type of compressor (e.g., reciprocating compressor, scroll compressor, screw compressor, centrifugal compressor, etc.) in other embodiments of dehumidification system 100.

In operation, moist airflow 101 is drawn into dehumidification system 100 via airflow inlet 104 by impeller 210. Airflow 101 travels through an air filter 202 before it reaches evaporator 204. The air filter 202 may be used to remove solid particles such as dust, pollen, mold, and bacterial from airflow 101. The filtered airflow 101 then enters evaporator 204 where airflow 101 is cooled and water is condensed and removed from airflow 101. The water removed from airflow 101 drips down the coils of evaporator 204 and falls into drain pan 208. Next, the dry airflow 101 passes through condenser 206 and is reheated by the refrigerant in the condenser 206. The now dehumidified, re-warmed airflow 101 exits dehumidification system 100 via airflow outlet 106. In some embodiments, a hose (not shown) connected to drain pan 210 will guide the water out of dehumidification system 100.

FIG. 3A illustrates a perspective view of drain pan 208 of dehumidification system 100, according to certain embodiments. Drain pan 208 is generally used to collect water condensed from evaporator 204. In some embodiments, drain pan 208 is any appropriate tank, basin, container, or area within cabinet 102 to collect and hold water removed from airflow 101. In some embodiments, drain pan 208 is located partially below evaporator 204 and condenser 206. In some embodiments, drain pan 208 includes a basin 302, a central ridge 304, a shelf 306, and a mist eliminator 308 as illustrated. Basin 302 of the drain pan 208 is located partially below the evaporator 204 and configured to collect water condensed from the evaporator 204. Basin 302 may be further configured to provide support for the evaporator 204. Central ridge 304 is located proximate to the basin 302 and configured to accommodate a mist eliminator 308 and prevent water from leaving basin 302 towards the downstream side, relative to airflow direction 101. Shelf 306 is located proximate to central ridge 304 so that central ridge 304 is sandwiched between the basin 302 and shelf 306 along a longitudinal direction 310. Shelf 306 is configured to provide support for condenser 206. Mist eliminator 308 is coupled to or otherwise located on central ridge 304 along a lateral direction 312 that is perpendicular to the longitudinal direction 310. Mist eliminator 308 is configured to remove water entrained in the air flowing through the drain pan 208.

Basin 302 of the drain pan 208 includes a first rib 314, a second rib 316, a third rib 318, an angled rib 320, a drain opening 322, and a sloped bottom 324. FIGS. 3B-3D further illustrates various cross-sectional perspective views of the basin 302, according to some embodiments. Sloped bottom 324 includes multiple panels that are sloped to allow water to flow from a first side 326-1 of basin 302 to a second side 326-2 of basin 302. First side 326-1 and second side 326-2 are generally parallel to the longitudinal direction 310, in some embodiments. First rib 314, second rib 316, third rib 318, and angled rib 320 are disposed on sloped bottom 324. Specifically, first rib 314 is positioned between a third side 326-3 and a fourth side 326-4 of basin 302. Third side 326-3 and fourth side 326-4 are generally perpendicular to the longitudinal direction 310, in some embodiments. First rib 314 extends upwardly from sloped bottom 324 and partially across sloped bottom 324 along lateral direction 312. Second rib 316 is positioned between first rib 314 and third side 326-3 of basin 302. Like first rib 314, second rib 316 extends upwardly from sloped bottom 324 and partially across sloped bottom 324 along lateral direction 312. Second rib 316 is generally parallel to first rib 314, in some embodiments.

In some embodiments, first rib 314 and second rib 316 are configured to be positioned underneath the lowest coils of evaporator 204 and are configured to restrict an area between evaporator 204 and drain pan 208 through which air may pass. This configuration minimizes the gap between evaporator 204 and drain pan 208, restricts the air flowing between the evaporator 204 and the drain pan 208, reduces the volume of the air flowing through the drain pan 208, and prevents airflow 101 from flowing underneath evaporator 204 and picking up the condensed water in the drain pan 208, thereby preventing water from being entrained in the air and improving the efficiency of the dehumidification system 100.

In some embodiments, second rib 316 includes a central gap 328 as illustrated. Central gap 328 is configured to allow water to drain from backside of the second rib, in relation to air flow direction 101, towards drain opening 322. Specifically, central gap 328 is configured to allow water to pass through second rib 316. This avoids completely restricting the air flowing through drain pan 208 which would reduce the amount of air passing through the dehumidification system 100, thereby reducing the efficiency of the dehumidification system 100. Additional air flow through the drain pan would directly contribute to the total airflow across the condenser, reducing the head pressure and increasing efficiency of the unit.

In some embodiments, third rib 318 is positioned between first rib 314 and second rib 316. Third rib 318 extends upwardly from sloped bottom 324 and partially across sloped bottom 324 along lateral direction 312. In some embodiments, third rib 318 is parallel to first rib 314 and is shorter in length than first rib 314 as illustrated. Third rib 318 is configured to at least partially block airflow through central gap 328 of second rib 316 along longitudinal direction 310. The requirement of the third rib 318 is determined by the distance between the first rib 314 and second rib 316. If the distance between first rib 314 and second rib 316 is small, then the first rib 314 will be able to sufficiently reduce airflow through the central gap in the longitudinal direction 310.

Like third rib 318, angled rib 320 is positioned between first rib 314 and second rib 316. In some embodiments, angled rib 320 is further positioned between third rib 318 and second side 326-2 of basin 302. Angled rib 320 extends upwardly from sloped bottom 324 and is attached to second rib 316 as illustrated. Referring to FIG. 3E, angled rib 320 may be inclined towards third rib 318 and have an angle 330 with respect to second rib 316. In some embodiments, angle 330 is in a range of 30° to 50°. Yet in other embodiments, angle 330 may be any appropriate angle.

First rib 314, second rib 316, third rib 318, and angled rib 320 work together to change the velocity vector of the air flowing through drain pan 208. FIG. 3E illustrates an example of the velocity vectors for a streamline in airflow 101 passing through drain pan 208. As noted before, first rib 314 is configured to restrict airflow by minimizing the gap between evaporator 204 and drain pan 208. First rib 314 further reduce the velocity of airflow 101 by the time it reaches second rib 316. Specifically, first rib 314 reduces the velocity of the airflow 101 by allowing a portion of airflow 101 to flow around first rib 314. Third rib 318 and angled rib 320 are configured to change the velocity vector of airflow 101. Without third rib 318 and angled rib 320, airflow 101 may flow around first rib 314, exit central gap 328 of second rib 316, and be directed sideways towards first side 326-1 of basin 302. A portion of the airflow 101 exiting central gap 328 may carry entrained water out of the drain pan 208 or from the bottom corner of evaporator 204, thereby decreasing the efficiency of dehumidification system 100. Third rib 318 and angled rib 320 change the velocity vector of the portion of airflow 101 exiting central gap 328 to be more parallel to longitudinal direction 310. The change in velocity vector works to direct the highest velocity airflow through the mist eliminator 308 to remove any water droplets that have been entrained in the airflow 101. Referring back to FIG. 3A, basin 302 further includes a drain opening 322. In some embodiments, drain opening 322 is located at fourth side 326-4 of basin 302. Drain opening 322 may be proximate to second side 326-2 of basin 302 so that water flowing from first side 326-1 to second side 326-2 may be drained out of dehumidification system 100 via drain opening 322.

In some embodiments, drain pan 208 further includes a central ridge 304 located proximate to basin 302. Specifically, the central ridge 304 is located proximate to third side 326-3 of basin 302. In some embodiments, central ridge 304 includes a wall along lateral direction 312 as illustrated. Central ridge 304 is configured to accommodate a mist eliminator 308 and prevent water from leaving basin 302 to the downstream side. As illustrated, mist eliminator 308 is disposed on central ridge 304 and is extending along lateral direction 312. Referring to FIG. 3G, in some embodiments, mist eliminator 308 includes a member 333 extending along lateral direction 312, a plurality of apertures 332 on member 333, and one or more hooks 338 that allow mist eliminator 308 to be coupled to central ridge 304. Mist eliminator 308 is generally configured to remove the water entrained in the air flowing through drain pan 208. Referring to FIG. 3F, mist eliminator 308 may have an angle 334 with respect to a vertical direction 336. Angle 334 may be in a range of 0-90°. For example, when angle 334 is zero degree with respect to vertical direction 336, mist eliminator 308 is parallel to the vertical direction. When angle 334 is 90° with respect to vertical 336 direction, mist eliminator 308 is perpendicular to vertical direction 336. In some embodiments, mist eliminator 308 includes a plurality of apertures 332 configured to minimize air restriction during normal operation but remove water droplets during defrost conditions. Most often, defrost conditions are the worst for water entrainment because the coil is still completely frozen in some locations, which restricts air flow in that location leading to higher velocities through the remaining evaporator coil or drain pan, and there is a large amount of water being melted from the coil. The melting water is then subject to the higher velocities, leading to increased water entrainment, decreasing the performance of the dehumidifier. In some embodiments, the apertures 332 are arranged in multiple rows in mist eliminator 308. For example, referring to FIG. 3G, mist eliminator 308 includes two rows of apertures 332. In some embodiments as illustrated, mist eliminator 308 includes an area that is not occupied by apertures 332. The area that is not occupied by apertures 332 is located in the area of highest air velocity caused by central gap 328. The area not occupied by apertures 332 creates a larger air side restriction and subsequently changing the air velocity vectors coming off the bottom side of evaporator 204. For example, when airflow 101 carrying water droplets flows through mist eliminator 308, the water will make contact with the area of mist eliminator 308 that is not occupied by apertures 332. The water droplets will then flow back down into the drain pan 208 and can be removed from the dehumidifier via drain opening 322, increasing the efficiency of the dehumidifier. The water droplets are prevented from going away from drain pan opening 322 by the central ridge 304.

FIG. 3H illustrates how mist eliminator 308 changes vectors of airflow 101. Without mist eliminator 308, airflow 101 flowing through drain pan 208 will have a velocity vector 340 as illustrated. This allows the water droplets on the bottom right side of evaporator 204 to be pulled over central ridge 304 and out of basin 302. On the other hand, with mist eliminator 308, airflow 101 flowing through drain pan 208 will have velocity vectors 342 as illustrated. Here, mist eliminator 308 changes the velocity of airflow 101 from vector 340 to vectors 342, thereby preventing the water droplets from leaving an area where it would drain back to drain opening 322. Referring back to FIG. 3A, drain pan 208 further includes a shelf 306.

Shelf 306 is located proximate to central ridge 304 partially below condenser 206. Shelf 306 may include a horizontal member configured to provide support for condenser 206.

The scope of this disclosure encompasses all changes, substitutions, variations, alterations, and modifications to the example embodiments described or illustrated herein that a person having ordinary skill in the art would comprehend. The scope of this disclosure is not limited to the example embodiments described or illustrated herein. Moreover, although this disclosure describes and illustrates respective embodiments herein as including particular components, elements, feature, functions, operations, or steps, any of these embodiments may include any combination or permutation of any of the components, elements, features, functions, operations, or steps described or illustrated anywhere herein that a person having ordinary skill in the art would comprehend. Furthermore, reference in the appended claims to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative. Additionally, although this disclosure describes or illustrates particular embodiments as providing particular advantages, particular embodiments may provide none, some, or all of these advantages.

What is claimed is:

1. A dehumidification system, comprising:
an evaporator;
a drain pan comprising:
a basin disposed at least partially below the evaporator, the basin comprising:
a sloped bottom configured to allow water to flow from a first side of the basin towards a second side of the basin, the first and the second side being parallel to a longitudinal direction;
a first rib disposed on the sloped bottom and positioned between a third side of the basin and a fourth side of the basin, the third and the fourth side being perpendicular to the longitudinal direction, the first rib extending upwardly from and partially across the sloped bottom along a lateral direction, the lateral direction being perpendicular to the longitudinal direction;
a second rib disposed on the sloped bottom and positioned between the first rib and the third side of the basin, the second rib extending upwardly from and partially across the sloped bottom, the second rib being parallel to the first rib, the second rib comprising a central gap configured to allow water to drain through the drain pan;
a third rib disposed on the sloped bottom and positioned between the first rib and the second rib, the third rib extending upwardly from and partially across the sloped bottom, the third rib being parallel to and shorter than the first rib and configured to at least partially block the central gap of the second rib along the longitudinal direction; and
a drain opening disposed on one side of the basin; and
a mist eliminator disposed on the drain pan, the mist eliminator comprising a member extending along the lateral direction, the member comprising at least one aperture.

2. The dehumidification system of claim 1, further comprising an angled rib disposed on the sloped bottom and positioned between the first rib and the second rib, the angled rib being further positioned between the third rib and the second side of the basin, the angled rib extending upwardly from the sloped bottom and attached to the second rib, the angled rib having an angle with respect to the second rib and inclined towards the third rib.

3. The dehumidification system of claim 1, wherein the drain pan further comprises a central ridge disposed proximate to the third side of the basin, the central ridge comprising a wall along the lateral direction and configured to accommodate the mist eliminator.

4. The dehumidification system of claim 3, wherein the drain pan further comprises a shelf disposed proximate to the central ridge and configured to support a condenser, wherein the central ridge is sandwiched between the basin and the shelf.

5. The dehumidification system of claim 3, wherein the mist eliminator is disposed on the central ridge of the drain pan.

6. A dehumidification system, comprising:
an evaporator;
a drain pan comprising:
a basin disposed at least partially below the evaporator and comprising:
a sloped bottom configured to allow water to flow from a first side of the basin toward a second side of the basin;
a rib disposed on the sloped bottom, and extending upwardly from and partially across the sloped bottom, the rib comprising a central gap configured to allow water to drain through the drain pan; and
a drain opening disposed on one side of the basin; and
a mist eliminator disposed on the drain pan, the mist eliminator comprising a member extending substantially parallel to the rib at a distance in a direction longitudinal to the rib with respect to a length of the rib, the member comprising a first part having at least one aperture and a second part without an aperture, wherein the second part without an aperture is located in an area of highest air velocity caused by the central gap.

7. The dehumidification system of claim 6, wherein the rib comprises a first rib and the basin further comprising a second rib disposed on the sloped bottom and positioned substantially parallel to the first rib such that the first rib is positioned between the second rib and the mist eliminator, the second rib extending upwardly from and partially across the sloped bottom.

8. The dehumidification system of claim 6, wherein the rib comprises a first rib and the basin further comprising a second rib disposed on the sloped bottom, and extending upwardly from and partially across the sloped bottom, the second rib being substantially parallel to and shorter than the first rib, and configured to at least partially block the central gap of the first rib.

9. The dehumidification system of claim 6, further comprising an angled rib extending upwardly from the sloped bottom and attached at a non-perpendicular angle to the first rib toward the first side of the basin.

10. The dehumidification system of claim 6, wherein the drain pan further comprises a central ridge disposed proximate to a third side of the basin and configured to accommodate the mist eliminator.

11. The dehumidification system of claim 10, wherein the drain pan further comprises a shelf disposed proximate to the central ridge and configured to support a condenser, wherein the central ridge is sandwiched between the basin and the shelf.

12. The dehumidification system of claim 10, wherein the mist eliminator is disposed on the central ridge of the drain pan.

13. A dehumidification system, comprising a drain pan, the drain pan comprising:

a basin comprising:

a sloped bottom configured to allow water to flow from a first side of the basin towards a second side of the basin, the first and the second side being parallel to a longitudinal direction;

a first rib disposed on the sloped bottom and positioned between a third side of the basin and a fourth side of the basin, the third and the fourth side being perpendicular to the longitudinal direction, the first rib extending upwardly from and partially across the sloped bottom along a lateral direction, the lateral direction being perpendicular to the longitudinal direction;

a second rib disposed on the sloped bottom and positioned between the first rib and the third side of the basin, the second rib extending upwardly from and partially across the sloped bottom, the second rib being parallel to the first rib, the second rib comprising a central gap configured to allow water to drain through the drain pan;

a third rib disposed on the sloped bottom and positioned between the first rib and the second rib, the third rib extending upwardly from and partially across the sloped bottom, the third rib being parallel to and shorter than the first rib and configured to at least partially block the central gap of the second rib along the longitudinal direction; and a drain opening disposed on one side of the basin.

14. The dehumidification system of claim 13, further comprising a mist eliminator disposed on the drain pan, the mist eliminator comprising a member extending along the lateral direction, the member comprising at least one aperture.

15. The dehumidification system of claim 13, further comprising an evaporator, wherein the basin of the drain pan is disposed at least partially below the evaporator.

16. The dehumidification system of claim 13, further comprising an angled rib disposed on the sloped bottom and positioned between the first rib and the second rib, the angled rib being further positioned between the third rib and the second side of the basin, the angled rib extending upwardly from the sloped bottom and attached to the second rib, the angled rib having an angle with respect to the second rib and inclined towards the third rib.

17. The dehumidification system of claim 13, further comprising an angled rib extending upwardly from the sloped bottom and attached at a non-perpendicular angle to the second rib toward the first side of the basin.

18. The dehumidification system of claim 14, wherein the drain pan further comprises a central ridge disposed proximate to the third side of the basin, the central ridge comprising a wall along the lateral direction and configured to accommodate the mist eliminator.

19. The dehumidification system of claim 18, wherein the drain pan further comprises a shelf disposed proximate to the central ridge and configured to support a condenser, wherein the central ridge is sandwiched between the basin and the shelf.

20. The dehumidification system of claim 18, wherein the mist eliminator is disposed on the central ridge of the drain pan.

* * * * *